US005540166A

United States Patent [19]

Wiley

[11] Patent Number: 5,540,166

[45] Date of Patent: Jul. 30, 1996

[54] EDGE STEER FINISHING DEVICE AND METHOD

[75] Inventor: Thomas W. Wiley, Greer, S.C.

[73] Assignee: Diversified Systems, Inc., Greenville, S.C.

[21] Appl. No.: 214,794

[22] Filed: Mar. 16, 1994

[51] Int. Cl.[6] ..... D05B 35/10; B23Q 16/00

[52] U.S. Cl. ..... 112/475.03; 112/306; 112/470.07; 226/15; 271/227

[58] Field of Search ..... 112/475.03, 306, 112/308, 309, 153, 470.07, 470.36, 141, 147; 26/77; 271/184, 185, 227, 228; 226/15, 17

[56] References Cited

U.S. PATENT DOCUMENTS

| | | | |
|---|---|---|---|
| 3,013,612 | 12/1961 | Judelson | 112/203 |
| 3,417,718 | 12/1968 | Andersson | 112/203 |
| 3,600,220 | 8/1971 | Marforio | 112/141 |
| 3,782,664 | 1/1974 | Alberto | 242/56 R |
| 4,095,538 | 6/1978 | Rockerath et al. | 112/147 |
| 4,565,362 | 1/1986 | Wiley | 112/470.36 X |
| 4,726,501 | 2/1988 | Wiley | 26/77 X |
| 4,825,787 | 5/1989 | Babson et al. | 112/262.3 |
| 4,836,119 | 6/1989 | Siraco et al. | 112/306 |
| 4,966,090 | 10/1990 | Tanaka et al. | 112/456 |
| 5,044,289 | 9/1991 | Keeton | 112/178 |
| 5,203,268 | 4/1993 | Schips | 112/121.27 |
| 5,289,788 | 3/1994 | Fukumoto | 112/306 X |
| 5,415,118 | 5/1995 | Adamski, Jr. et al. | 112/306 X |
| 5,461,999 | 10/1995 | Marcangelo | 112/306 |

*Primary Examiner*—Peter Nerbun
*Attorney, Agent, or Firm*—Henry S. Jaudon; Cort Flint

[57] ABSTRACT

A fabric conveying, aligning and fabricating system comprising a table having a support surface having a length over which fabric blanks are conveyed with continuous and uninterrupted movement. Conveyors are associated with the table which are adapted to convey successive fabric blanks over the support surface. Fabric blank aligning apparatus is arranged intermediate the support surface length and includes steering apparatus operable to steer a longitudinal edge of the fabric blank. Edge sensing apparatus is operative to sense the location of the longitudinal edge of the fabric blank relative to a fixed reference during its movement over the support surface. The edge sensing apparatus is operative to actuate the edge steering apparatus which acts continuously to positively steer the longitudinal edge along the fixed reference during the movement of the fabric blank through the aligning apparatus. The aligning apparatus also includes fabric blank end control apparatus. The end control apparatus comprises a rotating press belt arranged above the support surface, an idler roll carrying the forward section of the press belt, and apparatus mounting the idler roll for movement between a first position elevated above the support surface and a second position in contact with the support surface. Sensing means operates to sense the departure of a fabric blank from the aligning apparatus and acts to control the idler roll between the first and second position.

36 Claims, 6 Drawing Sheets

EDGE STEER FINISHING DEVICE AND METHOD

BACKGROUND OF THE INVENTION

This invention is directed to apparatus for supporting, positioning and conveying successive cut fabric blanks to and through an article forming or edge finishing station.

Various systems have been developed to supply fabric to article forming or edge finishing stations with varying degrees of success. Also various types of edge folding devices which act to turn or fold cut fabric edges of fabric blanks for edge seaming are now in use. Essential to any article forming or edge finishing operation is aligning the fabric edge during the finishing operation. Again there exist numerous devices directed to fulfilling this need.

U.S. Pat. Nos. 3,013,513; 3,417,718; 4,825,788; and 4,836,119 are each directed to known fabric edge aligning devices which control the position of the edge of a fabric being delivered through a serving station. None of these patents teach controlling or steering the fabric edge with a plurality of positively driven edge guide rollers which actuate between engaged and disengaged positions while maintaining continuous engagement and interaction with the cloth.

U.S. Pat. Nos. 3,600,220; 5,044,289; and 5,203,268 show apparatus for turning or tucking the edge of a fabric being delivered to a sewing station. These and other tucking devices are well known. It is to be noted, however, that these patents do not disclose apparatus to control the fabric edge through the sewing station.

Finally, U.S. Pat. No. 4,095,538 is directed to a material folding and article forming device. The arrangement includes a support surface over which conveyor belts support and convey fabric blanks through a sewing station. Upper and lower conveyor systems act to engage and move the fabric edge through the tucking and sewing stations. The arrangement does not provide for means to align the edge of the fabric prior to delivery to the edge tucking and sewing stations.

The instant arrangement has for its object to provide a system in which fabric blanks delivered to a support table are positively engaged with steering apparatus so that their longitudinal edges aligned relative to a reference point as the fabric is drawn across the support surface.

Another object of the invention is to maintain aligned the longitudinal edges continuously as the fabric is drawn across the support surface, through the tucking devices and through the sewing station.

Another object of the invention is to provide apparatus which continuously controls the position of a fabric blank on the support surface as its edges are folded and tucked during its movement across the support surface.

Another object of the invention is to provide an aligning system operative to steer and maintain a longitudinal edge of a fabric blank along its entire length into position relative to a fixed reference.

Another object of the invention is to control the positioned and folded fabric edge through a sewing station.

Another object of the invention is to provide for a smooth and uniform edge fold along its entire length.

Another object of the invention is the provision of a yarn tail engaging and severing apparatus which operates at an extremely high rate of efficiency.

Another object of the invention is to provide an aligning, conveying, shaping, and forming device which will function at a high rate of speed with a minimum of down time.

SUMMARY OF THE INVENTION

This invention is directed to a device for conveying, steering, and hemming cut fabric blanks. The device includes an elongated table having a support surface for supporting and conveying the fabric blanks. The table includes conveying apparatus which transport the fabric, in an uninterrupted manner, longitudinally over its support surface.

The table, is divided into a receiving section, an aligning section and a fabricating section. The receiving section receives the cut fabric blanks from a fabric supply and delivers them to the aligning section with their unfinished edges being generally aligned with opposite edges of the table. In the aligning section an intermittently operating end control apparatus is provided to control only out going ends of the fabric blanks moving through the aligning section. The aligning section also includes a steering mechanism which operates to continuously adjust the position of the longitudinal edges of each of the fabric blanks relative to a fixed reference during their uninterrupted movement through the aligning section and into the fabricating section.

The conveying apparatus includes a plurality of rotating and longitudinally extending conveyor belts which support and convey successive fabric blanks over the support surface through the receiving section, the aligning section and the fabricating section.

Control belts are arranged within the fabricating section which act to engage and maintain the aligned fabric blanks in the aligned position as they pass from the aligning section during their uninterrupted longitudinal movement into and through the fabricating section.

The aligning section includes transversely spaced apertures formed in the support surface adjacent to the receiving section and also adjacent to longitudinal edges of the support surface. A steering roller is rotatably mounted beneath each of these apertures, with a portion of its periphery passing through the aperture to be slightly above the support surface. The rollers are driven in the direction of longitudinal movement of the conveying belts. A first of the steering rollers is arranged with its plane of rotation at an obtuse angle relative to the axis of the longitudinal movement of the fabric blanks and the second of the steering rollers is arranged with its plane of rotation at an acute angle relative to this axis of movement. Reciprocally mounted press rollers are arranged above each of the steering rollers, and are controlled to be selectively moved so that one of the press rollers is in contact with one of the first and second steering rollers at each edge of the fabric at all times. This action continuously steers the longitudinal edges of the fabric into alignment with the fixed reference during passage of each fabric blank over the support surface.

The press rollers are reciprocated by solenoids having reciprocal cores. The press rollers are mounted on the cores.

An electric sensor is arranged above the support surface and the fixed reference along each edge of the table. This sensor acts to control the movement of the press rolls into and out of contact with the steering rolls in response to the position of the fabric edge relative to the fixed reference. In practice the first steering roll when engaged with the first pressure roll guides the longitudinal edge of the fabric in a first direction relative to the fixed reference. Conversely, the second steering roll when engaged with the second pressure roll guides the longitudinal edge in the opposite direction relative the fixed reference. A single sensing element is used to control the position of both the first and second pressure rollers of each of the steering mechanisms.

The end control apparatus includes a press belt which rotates in the direction of movement of the fabric blanks and has one end carried by a reciprocal idler roller. The idler roller is arranged to support one end of the belt between a first position in engagement with and in control of successive trailing ends of the fabric blanks and a second position spaced above the support surface. The second spaced position of the belt and idler roller allows the edges of the fabric blanks to be moved transversely relative to the support surface. An end sensor is operative to actuate a positioning apparatus to move the idler roller between the first and second positions in dependence on the presence or absence of fabric beneath the sensor.

The control section includes a plurality of rotating retaining belts positioned above the support surface and arranged to engage the aligned fabric blanks departing the aligning section. The retaining belts act to maintain the aligned fabric blanks aligned throughout their uninterrupted passage through the fabricating section.

The fabricating section has an edge folding station which includes a tucking finger, a diagonal belt, lower press belts and an edge folder. The tucking finger is arranged adjacent an edge of the support surface and in position to engage and deflect the longitudinal edge of each of the fabric blanks about the edge of the support surface and into a position therebeneath. The deflection takes place during movement of the fabric blank over the support surface.

The diagonal belt is also located beneath the support surface and is arranged adjacent the tucking finger. As the tucked edge passes through the tucking finger, it is engaged by the diagonal belt which is rotating diagonally of but substantially in the direction of movement of the fabric blanks. The diagonal belt acts to retain and smooth or draw tight the tucked edge during the movement of each of the fabric blanks over the support surface. Lower press belts are located beneath the support surface and in position to receive the tucked edge from the diagonal belt. The lower press belts act to maintain the tucked edge in position and assist in the movement of the fabric blank through the edge folder.

The forward ends of the lower press belts are arranged along an axis parallel with the axis of the diagonal belt. This arrangement allows for the tucked edge, moving over the support surface, to be sequentially picked up from the diagonal belt as it is brought under the control of the lower press belts.

The fabricating section further includes a sewing machine arranged adjacent the edge of the support surface. The lower press belts along with the upper press belts act to maintain and move the tucked and folded edge of each of the fabric blanks to and through the sewing machine. After passing through the sewing machine the fabric blanks are released into the discharge section.

The discharge section includes cutting apparatus for receiving and cutting tails of sewing yarn which interconnect successive fabric blanks. This allows the fabricated fabric blanks to remain as independent units in the discharge section.

The invention also includes a method for stitching a longitudinal edge of a fabric blank in a continuous operation. The method includes depositing a fabric blank onto a support surface and moving the fabric blank over the support surface and through an aligning section, a fabricating section and a discharge section.

The method includes providing first and second fabric blank steering rolls for the aligning section. Controlling the first roll to be operative to steer the longitudinally moving fabric blank edge to the left relative its axis of longitudinal movement and controlling the second steering roll to be operative to move the fabric blank edge to the right relative the axis of longitudinal movement. The first and second rolls are controlled so that one of them is in steering engagement with the moving fabric blank at all times to continuously position the fabric blank relative to a fixed reference during its movement through the aligning section. Controlling the trailing end of the fabric blank during its movement out of the aligning section by moving a press belt from a raised position into contact with the trailing end.

The method includes passing the positioned fabric blank from the aligning section into the fabricating section where it is secured in position relative to the fixed reference on the support surface as it is moved over the fabricating section. This allows a longitudinal edge of the fabric blank to be accurately tucked as it moves through the fabricating section and further allows the tucked edge to be stitched during further movement of the fabric blank through the fabricating section.

While the preferred method is described as maintaining control of only one edge of the fabric blanks, it is contemplated that the method include simultaneously maintaining control of both longitudinal fabric edges moving over the support table.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
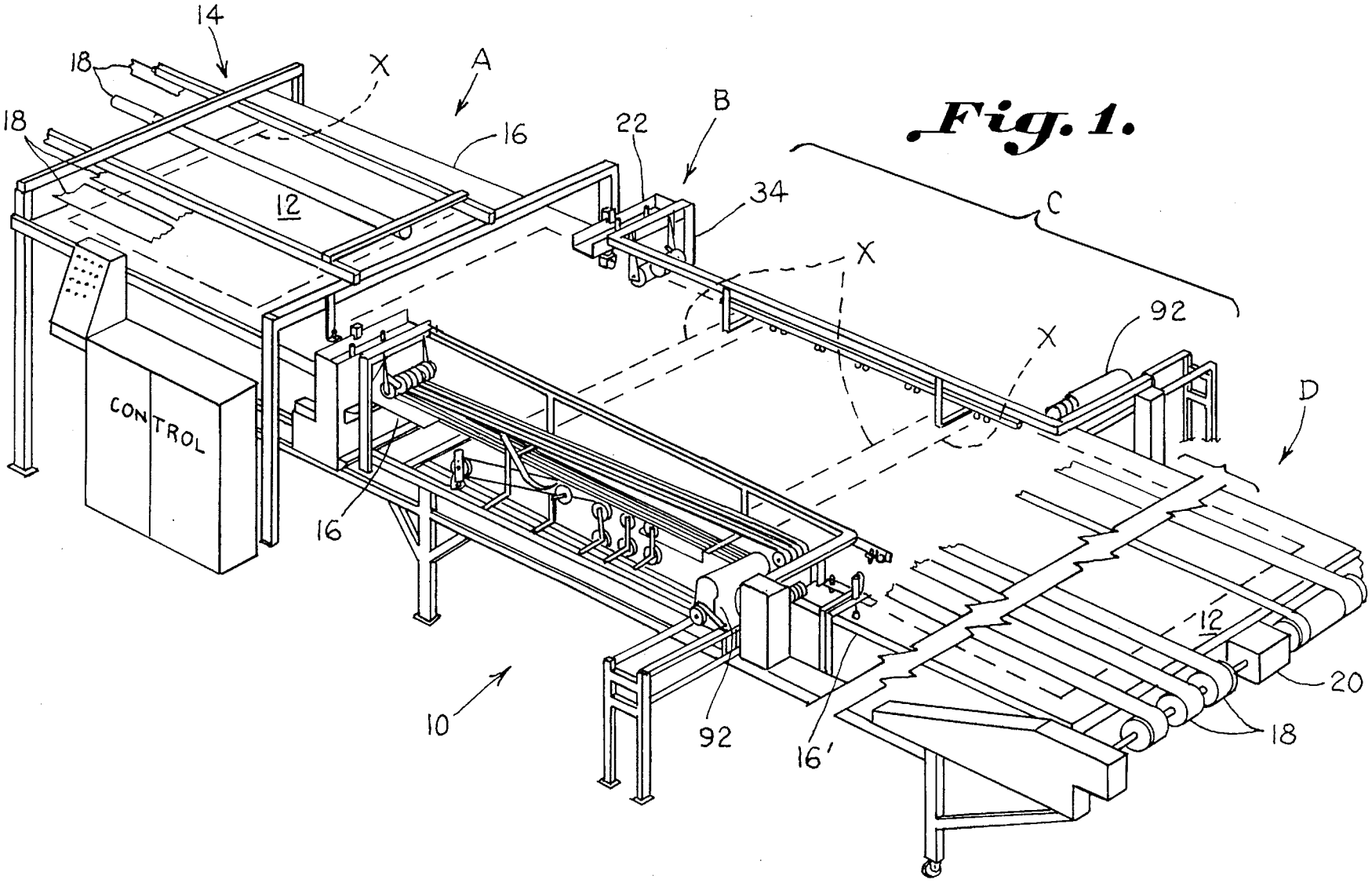
FIG. 1 is a perspective view of the fabric blank conveying and control apparatus according to the invention.

Referring now to the drawings in detail wherein like numerals denote like parts, FIG. 1 shows the fabric blank conveying, aligning and fabricating system of the invention. The arrangement consists of a support table 10 which includes a support surface 12. Support table 10 is divided into receiving section A, aligning section B, fabricating section C and discharge section D. FIG. 1 shows each of the sections A, B, C, and D arranged on opposite sides of support table 10 in substantially mirror image. Accordingly, the following detailed description will be restricted to the structure arrange only along one side of the table.

Arranged adjacent an end of receiving section A is a fabric blank supply system 14. This system, which forms no part of the instant invention, acts to measure fabric from a continuous supply and to cut the fabric into prescribed uniform lengths to form fabric blanks X. The fabric blanks X are then delivered and deposited onto the support surface 12 of receiving section A with the cut edges of each fabric blank being disposed along opposite edges 16 of support surface 12.

Arranged over support surface 12 along the entire length of table 10 are a plurality of conveyor belts 18. These belts are continuous, passing around a drive arrangement 19 at one end of the table 10, beneath the table and around guide means which are not shown at receiving end A, to form conveyors for transporting cut fabric blanks X over table 10.

After each fabric blank X is dropped onto conveying belts 18 in receiving section A, it immediately begins to be moved in an uninterrupted manner across table 10. As the fabric blank moves toward aligning section B its forward edge moves beneath electric sensor 20 of the end control arrangement 24. The end control arrangement is mounted on frame 22 of aligning section B and consists of a solenoid 30 with a reciprocating core 28 which carries idler roll 26 at its end. Press belt 32 is arranged about roll 26 at its forward end.

Figure 2:
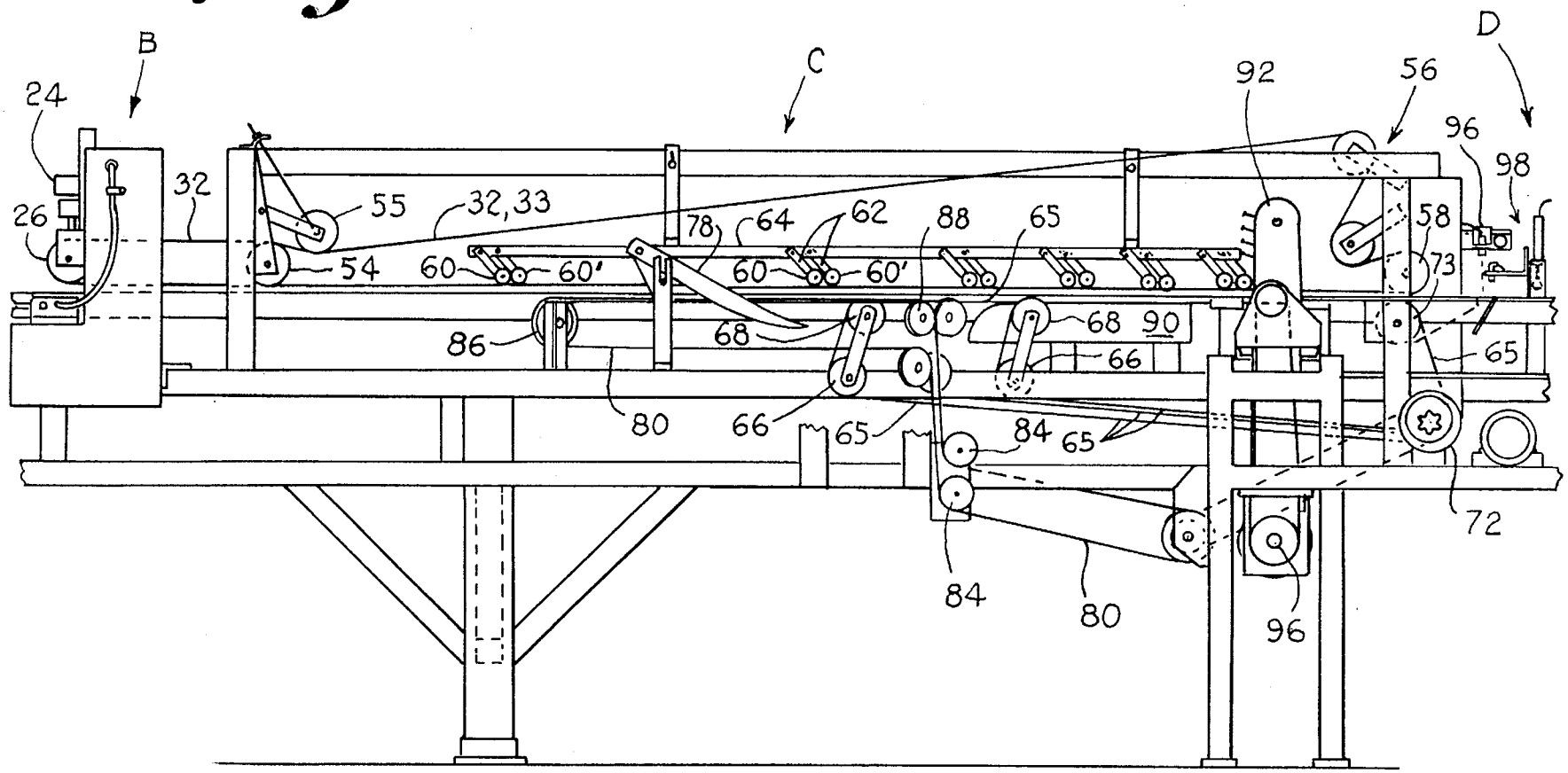
FIG. 2 is a side view of the device shown in FIG. 1.

End control 24 operates with core 28 normally in a retracted position with roll 26 and press belt 32 elevated above support surface 12 as shown in FIG. 2.

Press belt 32 is continuous with one surface extending above and in contact with surface 12 across the entire length of fabricating section C. The path of press belt 32 will be more firmly described hereinafter.

Aligning section B further includes fabric edge steering apparatus 34. This apparatus includes a pair of spaced solenoids 36, 37 mounted by suitable means with frame 22 above surface 12 and adjacent edge 16. Solenoids 36, 37 each include reciprocal cores which notably carry press rolls 38 at their lower ends.

Frame 22 also supports photo electric sensor 40 which is arranged over fixed reference 42 adjacent edge 16 of surface 12. Sensor 40 is arranged to activate either solenoid 36 or 37 in dependence upon whether or not reference 42 is covered by the fabric blank during its movement through aligning section B.

Arranged in support surface 12 beneath each solenoid 36, 37 is a cutout 44. Beneath each cutout 44 is positioned a driven steering roll 46, 47. Each steering roll is mounted on a drive shaft 48 which is driven by any usual driving mechanism 50 to rotate at substantially the same surface speed as conveyor belts 18.

Shaft 48 is positioned relative to cutouts 44 so that a portion of the outer periphery of steering rolls 46, 47 extends through the opening to be exposed slightly above surface 12. Steering roll 46 is arranged with its plane of rotation at an obtuse angle relative to the longitudinal axis of table 10 and steering roll 47 is arranged with its plane of rotation at an acute angle to that axis. It is preferred that the plane of rotation of roll 47 is arranged to between 5° and 45° and the plane of rotation of roll 46 is arrange to between 95° and 135° relative to the longitudinal axis of table 10. These angles may be varied as desired, the only requirement being that the plane of rotation of each roll 46, 47 diverge equally oppositely away from the longitudinal axis of the table.

Press rolls 38 are arranged directly over steering rolls 46, 47 with their plane of rotation substantially coinciding with that of the associated press roll.

In operation, the forward edge of the just delivered fabric blank X moves beneath sensor 20 and sensor 40 as it begins its uninterrupted movement across table 10. Sensor 20, sensing fabric, actuates solenoid 30 to retract core 28 which elevates roller 26 and the forward end of press belt 32 above surface 12. As the edge of the fabric blank passes fixed reference 42, sensor 40 actuates one of solenoids 36, 37 to bring a respective press roller 38 into engagement with its associated steering roll 46, 47. If the fabric edge covers reference 42, solenoid 36 is actuated to move its press roll 38 into contact with steering roll 46. This action causes the fabric edge to be moved to the left away from edge 16. When reference 42 is uncovered, sensor 40 actuates solenoid 37 bringing press roll 38 into contact with steering roll 47. This causes the fabric edge to be moved toward edge 16. Actuation of one solenoid 36, 37 by sensor 40 simultaneously deactivates the opposite solenoid. The activated solenoid remains active until the opposite solenoid is again actuated. As a result of this operation the fabric blank is always contacted and controlled and its edge is always being steered to the right or the left during its entire passage through the aligning system.

It is noted that the relatively small distance which steering rolls 46 and 47 move the fabric edge during the steering operation along with the lack of tension initially in the fabric blank allows the opposed aligning devices arranged on opposite sides of table 10 to operate simultaneously without one interfering with the other operation.

Just before the fabric blank completes its passage through the aligning section, sensor 20 senses no fabric and activates solenoid 30. This causes idler roll 26 carrying press belt 32 to be lowered into contact with surface 12 so that press belt 32 engages the departing end of the fabric blank and controls it so that the aligned position may be maintained as the fabric blank moves into the fabricating section. Immediately following the departure of this fabric blank, a succeeding fabric blank is positioned in feeding section A and its leading end and edge is brought into position to be sensed by sensors 20 and 40 and the aligning process is restarted.

The fabricating section C is arranged intermediately of table 10 and comprises securing apparatus, edge folding apparatus and sewing apparatus.

The securing apparatus comprises press belt 32 along with press belts 33 which are arranged over surface 12 adjacent an edge thereof in position to have a longitudinal run thereof in contact with the support surface. Press belts 32, 33 are driven in the direction of and synchronously with conveying belts 18. Press belts 32, 33 as shown in FIGS. 1–4 extend from drive 58 over idler system 56 to idler rollers 55, 54. From idler rollers 55, 54 belts 32, 33 extend over and in contact with surface 12 back to drive 58. Press belt 32, as earlier described, also extends beyond roller 54 to pass around idler 26. Between roller 54 and drive 58, the press belts are urged into contact with surface 12 by spring biased guide rollers 60, 60' which extend longitudinally over table 10 between guide roller 54 and drive roller 58. Rollers 60, 60' are mounted on pivotal arms 62 which are carried by frame 64 and are spring urged clockwise toward support surface 12 and against the upper surface of press belts 32, 33. The force at which rollers 60, 60' are urged against press belts 32, 33 is adjustable.

Figure 5:
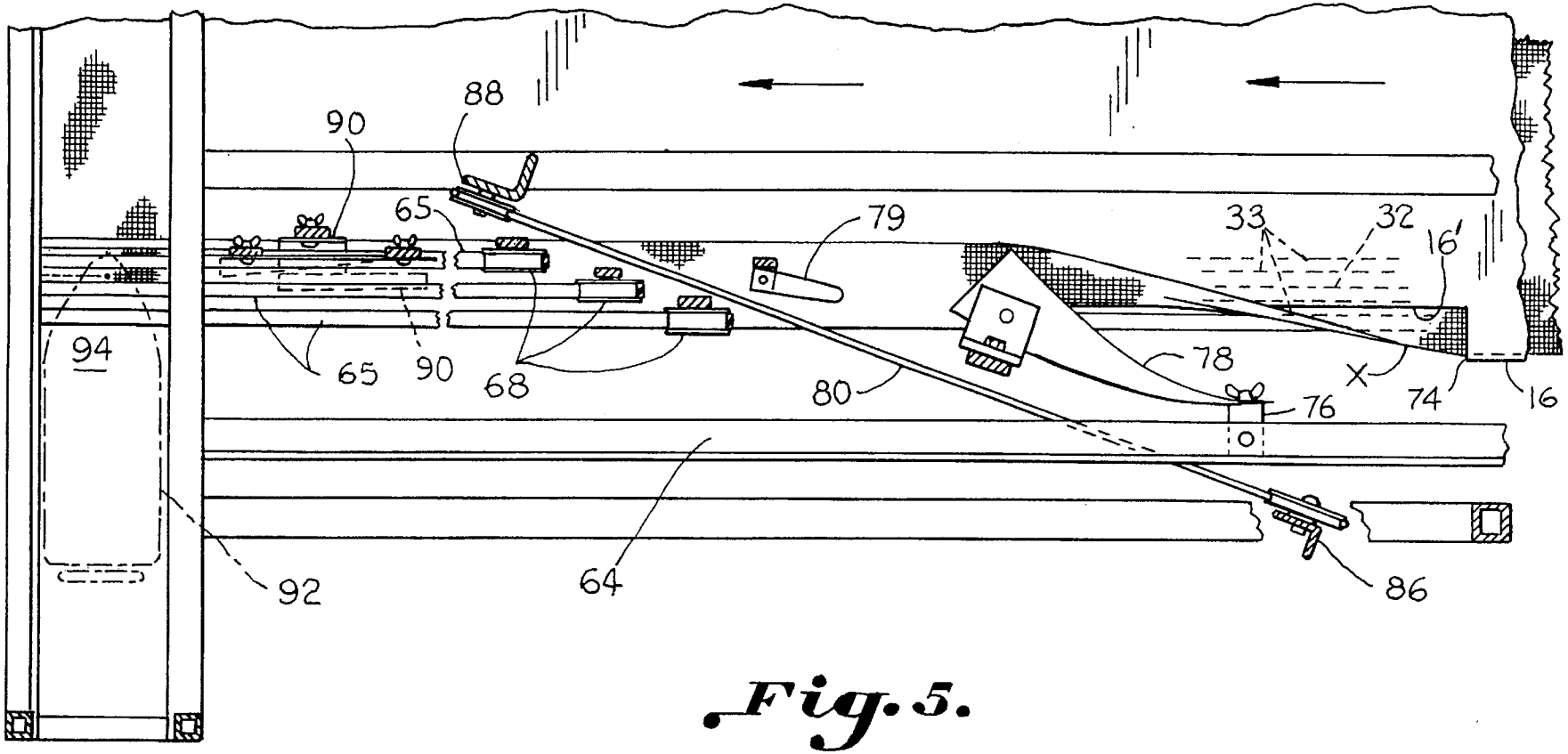
FIG. 5 is a sectional bottom view of the conveying and control apparatus showing the edge tucking and control of the conveying system.

As can best be seen in FIG. 5, lower press belts 65 are located beneath the surface 12 and are arranged to be substantially superimposed beneath press belts 32, 33. Lower press belts 65 extend from guide roll 73 downward and around guide roll 72, forward to and around guide rolls 66 and then up and over guide rolls 68. Guide rolls 68 are carried by arms 70 which are spring urged toward the lower surface of surface 12 so that the lower press belts forcibly engage this lower surface in their longitudinal run back to drive 72. Lower press belts 65 are also driven at the same speed as press belts 32, 33 and conveyor belts 18. In some instances, those lower press belts 65 which pass immediately adjacent the sewing needles in stitching section 94 may be driven slightly faster than all other belts. This action is sometimes necessary to prevent folds along the stitch line.

Figure 3:
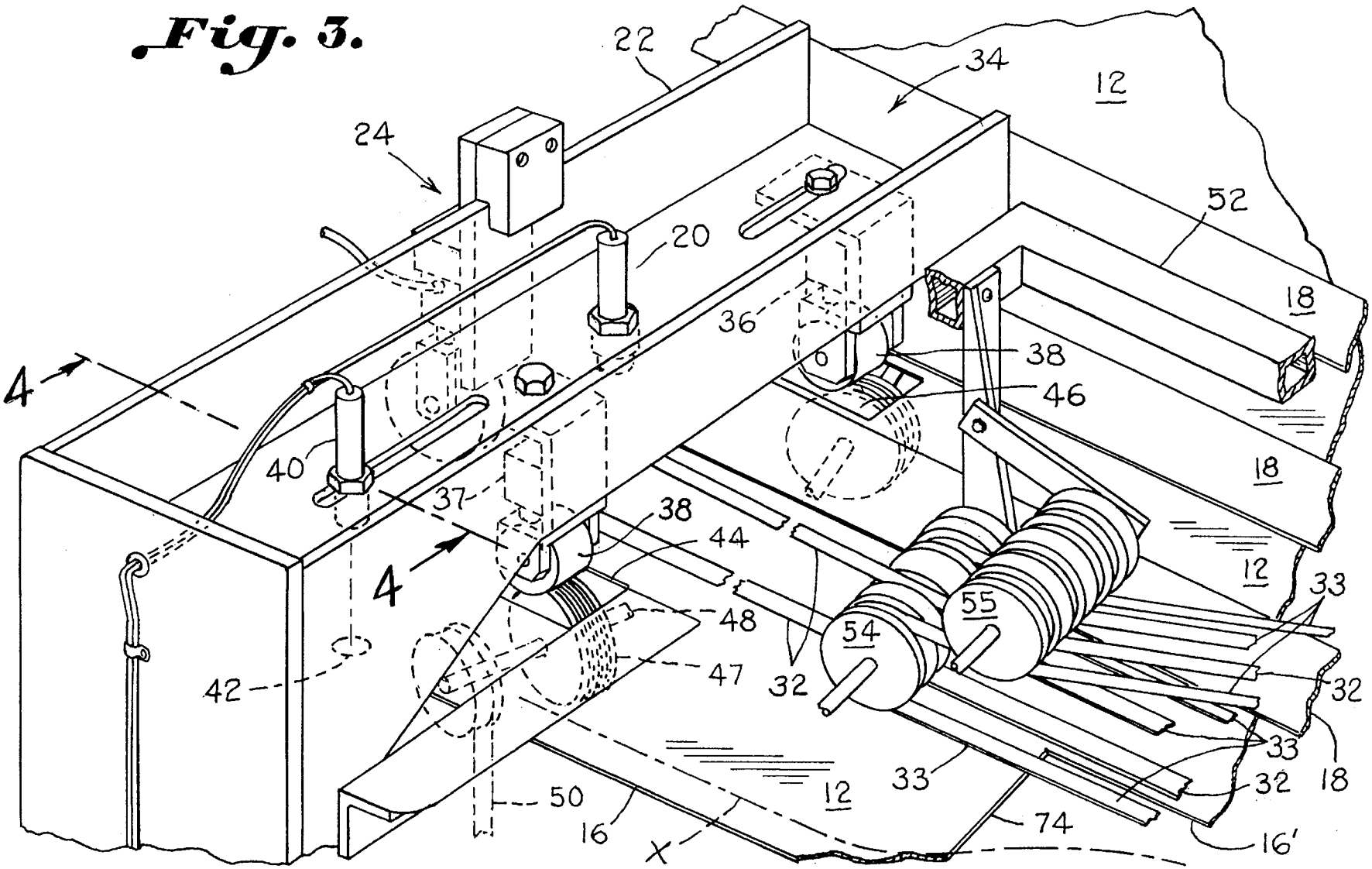
FIG. 3 is a sectional perspective view of the aligning apparatus of the conveying and control system.
Figure 4:
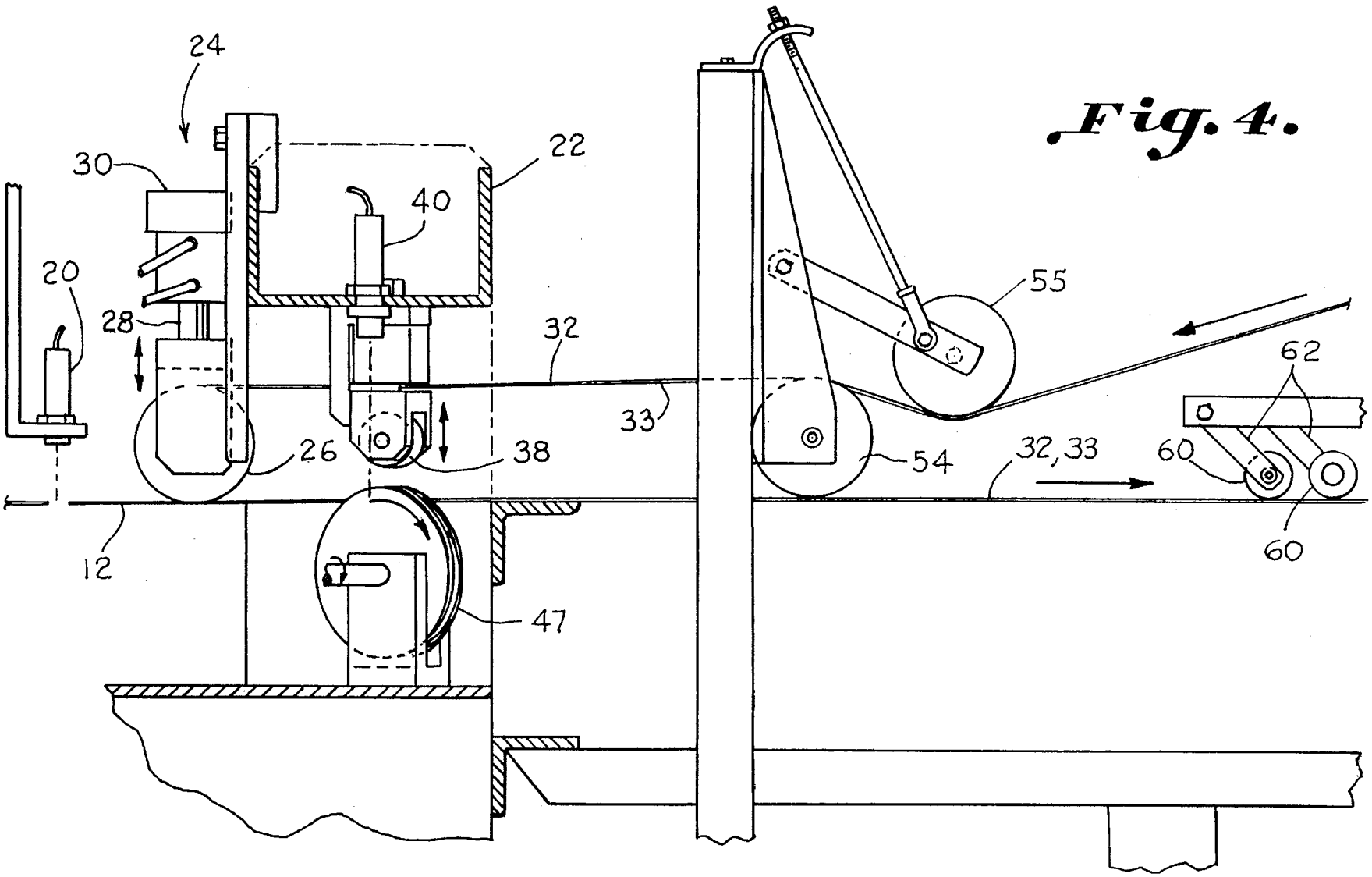
FIG. 4 is a sectional side view of the aligning apparatus shown in FIG. 3.

The longitudinal edge 16 of surface 12 is arranged along two vertical planes. Slightly behind idler rolls 54, edge 16 of surface 12 is recessed or cut away at 74 by an amount equal to the desired length of an edge tuck (FIG. 3). From recess 74, edge 16' continues along a single longitudinal axis over the remainder of surface 12.

As can best be seen in FIG. 5, located just behind recess 74, tucking finger 78 is adjustably secured with frame 64. Finger 78 is shaped to extend downwardly from frame 64 to engage with edge 16 to pass or fold the edge beneath surface 12. Tucking finger 78 may be constructed substantially as disclosed at 144 in U.S. Pat. No. 4,095,538. Just behind tucking finger 78 there may be arranged a press finger 79 which act to remove folds and to retain the tucked edge smoothly in engagement with the undersurface of table 10. Press finger 79 is no more than a small resilient finger.

Behind and adjacent tucking finger 78 there is arranged a continuous diagonal belt 80 which is driven in a direction somewhat offset from the direction of movement of conveying belts 18 by drive 82. Belt 80 passes over idler rolls 84 and then to idler roll 86 arranged forward of finger mount 76. Idler roll 88 is positioned beneath surface 12 and slightly forward of the end position of finger 78. Belt 80 passes diagonally from idler roll 86 to idler roll 88 with its upper surface contacting the under side of surface 12. From idler roll 88, belt 80 travels back to drive 72.

Guide rolls 66, 68 carrying lower press belts 65 are diagonally arranged beneath surface 12 (FIG. 5). Diagonal belt 80 is located so that it passes just behind finger 78 and just forward of the forward ends of lower press belts 65.

Referring now to FIGS. 2 and 5, there is arranged along the edge of the lower side of surface 12 an edge folder 90. This device forms no part of the instant invention and is fully described in U.S. Pat. No. 4,095,538. As seen in FIG. 5, lower press belts 65 pass both over and outwardly of edge folder 90.

A sewing machine 92 is arranged immediately behind edge folder 90. As seen in FIG. 5, lower press belts 65 pass beneath and in contact with the stitching section 94 of sewing machine 92. Inherently, this results in press belts 32, 33 passing over the upper surface of stitching section 94 as the press belts are superimposed. Sewing machine 92 is of usual construction and is driven by motor 96.

Figure 7:
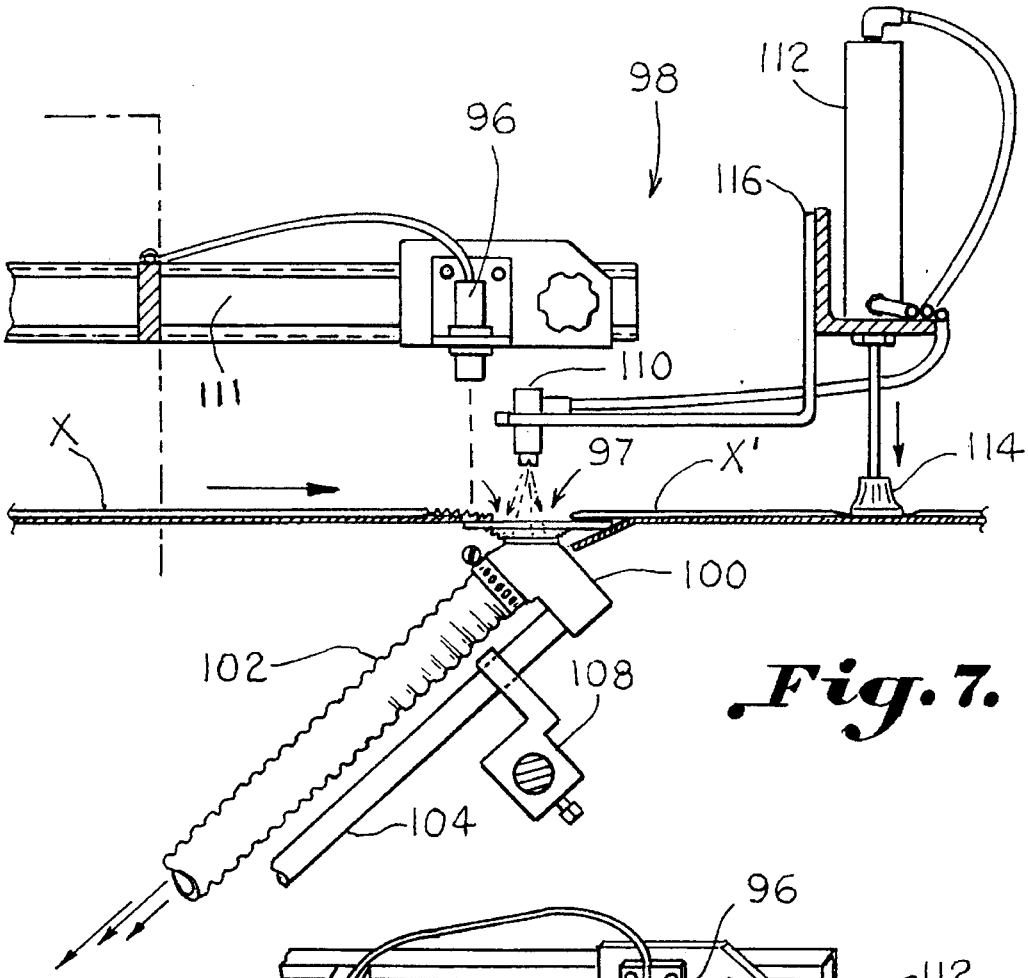
FIG. 7 is a sectional side view of the yarn cutting apparatus of FIG. 6.
Figure 6:
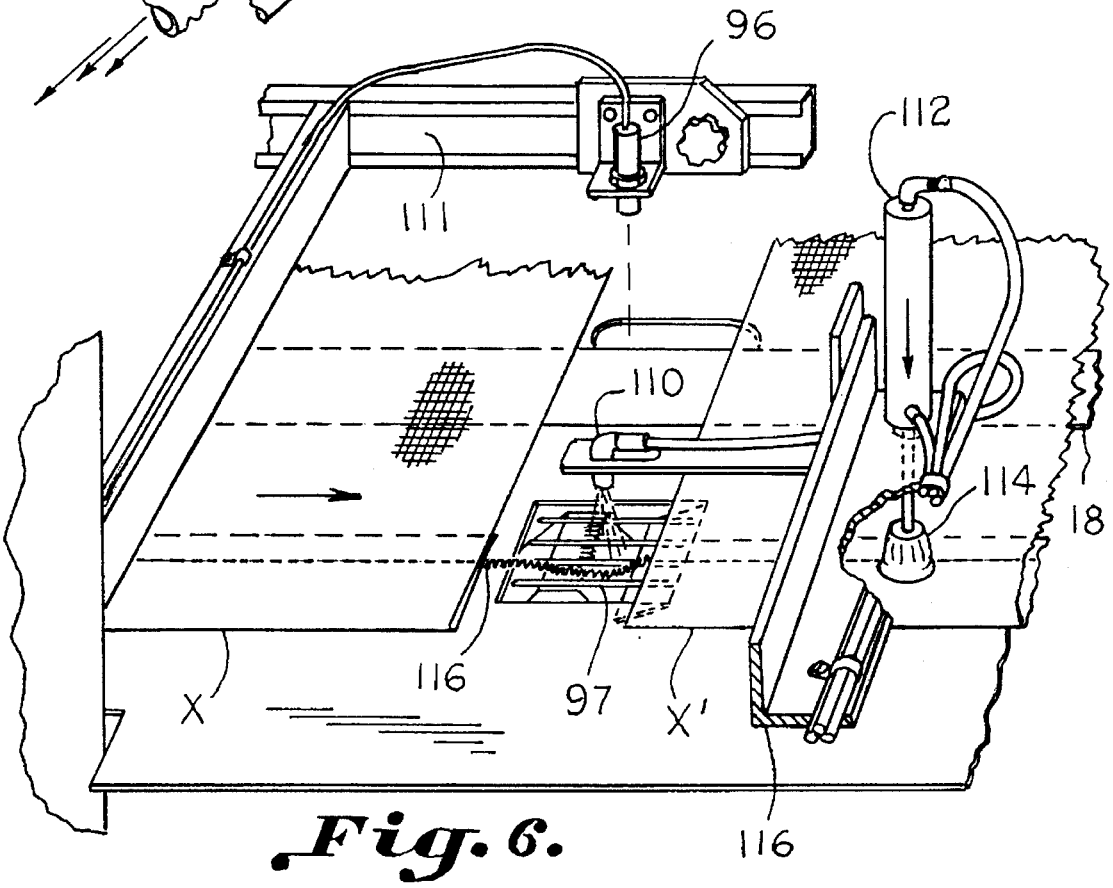
FIG. 6 is a sectional perspective view of yarn cutting and waste removal apparatus.

Press belts 32, 33, and 65 extend slightly beyond sewing machine 92 before they pass around drive rolls 58 and 72 to complete their cycle. Adjacent and rearward of drive rolls 58 and 72 is an electric sensing member 96. This sensing member controls thread cutter and waste removal device 98 (FIGS. 6 and 7) which is arranged along the edge of table 10. As the sewn fabric blanks X are discharged from belts 32, 33 and 65 into discharge section D adjacent fabric blanks are connected by tails formed of the sewing thread employed by sewing machine 92.

A thread cutting and waste removal apparatus 98 includes a cutting head 100 which comprises continuously driven reciprocal cutting blades. Vacuum hose 102 is connected with head 100 and provides a vacuum source which draws continuously through head 100 to assist in drawing in the yarn tails to be cut and to carry off the cut waste.

Cutting apparatus 98 is mounted beneath opening 97 formed in surface 12. Head 100 may be vertically adjusted along shaft 104 and horizontally adjusted along shaft 108 so that it may be precisely positioned relative to the opening.

A frame 116 is positioned above surface 62 and is adapted to carry nozzle 110 over opening 97. Nozzle 110 is arranged to direct a continuous air jet through opening 97 and into cutting head 100. Frame 116 also carries a pneumatic cylinder 112 which includes a reciprocal piston and foot 114. Cylinder 112 is capable of moving the piston between a raised position in which foot 114 is spaced from surface 12 and a lowered position in which foot 114 engages with surface 112. Photo electric sensing member 96 carried by frame 111 is operative to actuate cylinder 112 to move its piston between these two positions.

In practice, as each fabric blank X moves through sewing head 94 and its folded edge is stitched into position the fabric blank continues to be held in position by press belts 32 and 33. Upon departing the sewing station, the fabric blank X is passed into discharge section D. The successive fabric blanks remain interconnected by thread tails 116 at this point. Arranged at the edge of surface 12 and adjacent the entry area of the discharge section D is the cutting and separating apparatus 98. This apparatus includes an electric sensing member 96. As long as sensing member 96 detects fabric, cylinder 112 is controlled to maintain foot 114 raised. Upon sensing a separation between fabric blanks, sensor 96 causes cylinder 112 to lower foot 114 which secures fabric blank X' against surface 12 with yarn tail 116 extending over opening 97. As fabric blank X continues to move it moves toward fabric blank X' so that tail 116 is both blown and sucked into opening 97 and into cutting head 100 where it is severed. As fabric blank X continues to be fed, its forward edge passes beneath sensor 96 which causes cylinder 112 to raise foot 114 freeing fabric blank X' and allowing belts 18 to move it further into the discharge section D.

In operation, cut fabric blanks X are successively deposited onto surface 12 in receiving section A and begin continuous transport over table 10. As the fabric blank moves beneath sensors 20 and 40, idler 26 is elevated by solenoid 30 and one of press rolls 38 is moved into fabric engagement as dictated by the position of the fabric edge relative to fixed reference 42. Press rolls 38 operate in a piston manner with one of the rolls being in contact with the fabric blank at all times. This action by the press rolls positively controls and steers the fabric blank through aligning section B into fabricating section C.

As the aligned portion of the fabric blank passes beneath idler rolls 54, it is engaged by press belts 32, 33 which firmly hold the fabric blank X in its aligned position and also assist in conveying it across fabricating section C. The edge of the fabric blank is supported on surface 12 adjacent to edge 16 during movement through this area. Just beyond roll 54, edge 16 is recessed or out away, as shown at 74. The edge then continues at 16' inwardly of the outer edge of the fabric blank. The edge of fabric blank X drapes over continuing edge 16' by a length equal to the length of edge material desired to be tucked.

As fabric blank X continues to be moved though section C, the draped edge is moved into contact with tucking finger 78 which folds it under and into contact with the lower surface of support surface 12. See FIGS. 2, 3, and 5.

As the folded edge of the fabric blank emerges from tucking finger 78, it is engaged by diagonal belt 80. The upper run of diagonal belt 80, which is moving somewhat offset from the direction of lower press belts 65, is maintained in resilient contact with the under surface of support 12. As the tucked edge of the fabric blank is engaged by belt 80, it is drawn more tightly about edge 16' and the fold is drawn smooth.

Immediately down stream of diagonal belt 80 are arranged the lower press belts 65. These belts pass about rollers 66 with their ends substantially aligned with diagonal belt 80. This arrangement allows the lower press belts 65 to sequentially engage the tucked edge as it moves past diagonal belt 80 so that its smooth and stretched condition is maintained.

Lower press belts 65 are arranged in substantially vertical alignment with upper press belts 32, 33. This arrangement allows the fabric edge to be firmly held and evenly moved over surface 12 with even contact on both sides of the support surface.

The tucked and controlled fabric edge is passed through tucking device 90. These devices are well known in the industry and form no part of the instant invention. Device 90 may be of the type disclosed in U.S. Pat. No. 4,095,538. The outer edge of the tucked fabric is tucked again so that a clean edge is provided.

Upon completion of the tucking operation by tucking device 90, the tucked edge which is still engaged between press belts 32, 33 and lower press belts 65 is conveyed through edge sewing machines 92. This structure is also old and disclosed in the above referred to U.S. Pat. No. 4,095,538.

The conveying devices continue to move the fabric blank through the sewing machine 92 and into the discharge area D. As the fabric emerges from press belts 32, 33, 65 electric eye 96 detects the breaks between the fabric blanks. When a break is detected, cutter mechanism 98 is operative to sever sewing thread tails 116 left by the sewing machines which temporarily interconnect the fabric blanks.

The operation is efficient, accurate and is performed at a high rate. The finished fabric blanks which are delivered into discharge section D are subsequently packaged for distribution.

While a preferred embodiment of the invention has been described using specific terms, such description is for illustrative purposes only, and it is to be understood that changes and variations may be made without departing from the spirit or scope of the following claims.

What is claimed is:

1. A fabric conveying and steering system comprising:

an elongated table having a support surface for supporting and conveying cut fabric blanks, said table including means for conveying said fabric blanks in an uninterrupted manner longitudinally over said support surface and table;

said table including a receiving section, an aligning section and a fabricating section;

said receiving section sequentially receives said fabric blanks from a fabric supply;

said aligning section being arranged adjacent said receiving section to receive individually said fabric blanks therefrom, said aligning section including intermittently operative end control means which control only trailing ends of said fabric blanks moving through said aligning section, said aligning section further including a steering mechanism operative to continuously engage and adjust the position of a longitudinal edge of each said fabric blank relative to a fixed reference during its uninterrupted movement through said aligning section and into said fabricating section; and control means arranged within said fabrication section which act to engage and maintain said sequential fabric blanks in said aligned position during the uninterrupted longitudinal movement of each of said fabric blanks through said fabricating section.

2. The system of claim 1 where said conveying means include a plurality of longitudinally extending conveyor belts which support and convey said fabric blanks over said support surface through said receiving section, said aligning section and said fabricating section.

3. The system of claim 1 wherein said aligning section includes transversely spaced apertures formed in said support surface substantially adjacent said receiving section and substantially adjacent a longitudinal edge of said support surface, means rotatably mounting a steering roller beneath each said aperture and said support surface, with a portion of each periphery passing through a respective of said apertures to be slightly above said support surface, means driving said rollers in the direction of longitudinal movement of said conveying means and of each said fabric blank.

4. The system of claim 3 wherein a first of said steering rollers is arranged with its plane of rotation at an obtuse angle relative the axis of said longitudinal movement of each said fabric blank and a second of said steering rollers is arranged with its plane of rotation at an acute angle relative said axis of movement.

5. The system of claim 4 wherein said alignment section includes means reciprocally mounting a first and a second press roller respectively above said first and second steering rollers, and control means operative to selectively urge one of said first and second press rollers to be in contact with one of said first and second steering rollers at all times to continuously steer and maintain said one longitudinal edge in alignment with said fixed reference during said uninterrupted passage of each said fabric blank over said surface.

6. The system of claim 5 wherein said means reciprocally mounting said first and second press rollers include a pair of solenoids having reciprocal cores carrying said rollers;

electric sensor means arranged above said surface and said fixed reference, said electric sensor being operative to control movement of said press rolls into and out of contact with said steering rolls in response to the position of said longitudinal edge relative to said fixed reference.

7. The system of claim 6 wherein said first steering roll when engaged with said first pressure roll guides said longitudinal edge in a leftward direction relative to said fixed reference and said second steering roll when engaged with said second pressure roll guides said longitudinal edge in a rightward direction relative said fixed reference.

8. The system of claim 6 wherein said electric sensing means comprises a single sensing element operable to control the position of both said first and second pressure rollers.

9. The system of claim 1 wherein said end control means includes a press belt which rotates in the direction of movement of said fabric blanks and a reciprocal idler roller positioned to support one end of said belt between a first position in engagement with and in control of said ends of said successive fabric blanks and a second position spaced above said support surface and said successive fabric blanks moving over said support surface;

positioning means operative to move said roller between said first and second positions;

end sensing means operative to move said positioning means between said first and second positions in dependence on the presence of said successive fabric blanks beneath said sensing means during their uninterrupted movement through said aligning section.

10. The system of claim 1 wherein said fabricating section includes a plurality of rotating press belts positioned above said support surface and adapted to engage successive of said fabric blanks having said longitudinal edge aligned upon departing said aligning section, said press belts acting to maintain said fabric blanks in said aligned position throughout their uninterrupted passage through said control section.

11. The system of claim 1 wherein said fabricating section includes an edge folding section comprising a tucking finger, a diagonal belt, lower press belts and an edge folder;

said tucking finger being arranged adjacent an edge of said support surface in position to engage and deflect said longitudinal edge of respective of said fabric blanks about said support surface edge into a position beneath said support surface during movement of said fabric blank there;

said diagonal belt being located beneath said support surface adjacent said tucking finger in position to receive said tucked edge, said diagonal belt rotating substantially in the direction of movement of said fabric blanks and arranged at an acute angle relative to said edge of said support surface, said diagonal belt acting to retain and smooth said tucked edge during movement of said respective fabric blanks over said support surface.

12. The system of claim 11 wherein said lower press belts are located beneath said surface with their ends arranged in position to sequentially receive said tucked edge from said diagonal belt, said lower press belts act to maintain and move said tucked edge through said edge folder.

13. The system of claim 12 wherein said fabricating section further includes sewing means;

said lower press belts act to maintain and move said tucked and folded edge through said sewing means.

14. The system of claim 13 where said lower press belts and said press belts are substantially vertically aligned;

said press belts act to maintain and move said aligned edge through said sewing section.

15. The system of claim 12 wherein there are at least three of said lower press belts;

means mounting forward ends of said lower press belts along an axis parallel with the axis of said diagonal belt; whereby, said tucked edge sequentially moves from engagement with said diagonal belt into engagement with said lower press belts.

16. The system of claim 11 wherein said table further includes a discharge section into which said press belts and said lower press belts release said sewn fabric.

17. The system of claim 16 wherein said discharge section includes yarn tail cutting apparatus which is operative to sever connecting yarn tails interconnecting successive fabric blanks being discharged into said discharge section.

18. The system of claim 17 wherein said cutting apparatus includes means operative to control a fabric blank to be stationary during said severing operation.

19. The system of claim 17 wherein said cutting apparatus includes pneumatic means operative to control said yarn tail.

20. A method for stitching a longitudinal edge of a fabric blank in a continuous operation, said method including: depositing a fabric blank on a support surface; moving said fabric blank over said support surface through an aligning section, a fabricating section, and a discharge section; providing steering rolls on fixed axes along longitudinal edges of said fabric blank and selectively engaging said longitudinal edges of said fabric blank with selected ones of said steering rolls to steer said longitudinal edges continously during movement of said fabric blank through said aligning section, providing respective edge detectors adjacent opposite sides of said aligning section, and controlling the position of said longitudinal edges relative to said edge detectors during movement of said fabric blank through said aligning section; whereby said aligning section acts to position both longitudinal edges of said fabric blank for movement through said fabricating section.

21. The method of claim 20 including engaging a rear end of said fabric blank adjacent said longitudinal edges with a press belt only during movement of said fabric blank out of said aligning section.

22. The method of claim 20 including providing first and second steering rolls along said longitudinal edges, operating said first steering roll to steer said longitudinally moving fabric blank to the left relative to the axis of said longitudinal movement and said second steering roll to move said fabric blank to the right relative to the axis of said longitudinal movement; and controlling said first and second steering rolls so that only one of said rolls of said first and second steering rolls is in steering engagement with said moving fabric blank at all times during its passage through said aligning section to continuously position said fabric blank relative to a fixed reference during its uninterrupted movement through said aligning section.

23. The method of claim 22 including passing said positioned fabric blank from said aligning section into said fabricating section, securing the position of said fabric blank on said support surface with securing apparatus as it moves over said fabricating section; causing at least one of said longitudinal edges of said fabric blank to be tucked during movement of said fabric blank through said fabricating section; stitching said tucked edge of said fabric blank in said tucked position during movement of said fabric blank through said fabricating section; and, releasing said fabric blank from said securing apparatus for deposit into said discharge section.

24. A fabric conveying and steering system comprising: a table having a support surface having a length over which a fabric blank is conveyed with continuous and uninterrupted movement; conveying members associated with said table adapted to convey said fabric blank over said support surface; a fabric blank aligning section arranged intermediate said support surface length, said aligning section including a steering mechanism operable to steer at least one of a pair of longitudinal edges of said fabric blank, said aligning device including an edge sensing device operative to sense the location of a first longitudinal edge of said fabric blank relative to a fixed reference during movement of said first longitudinal edge over said support surface; said edge sensing device being operative to actuate said edge steering mechanism to act continuously to positively steer said first longitudinal edge along said fixed reference during movement of said fabric blank over said support surface; a fabric blank end control comprising a rotating press belt arranged above said support surface, an idler roll carrying a forward section of said press belt, mounting structure mounting said idler roll for movement between a first position elevated above said support surface and a second position in contact with said support surface; a sensing device operative to sense the departure of a fabric blank from said aligning section, said sensing device being operative to control said idler roll between said first and second positions; whereby, when said sensing device detects movement of a trailing end of a fabric blank out of said aligning section, said sensing device causes said idler roller and press belt to move into said second position and into engagement with said trailing end of said fabric blank.

25. The system of claim 24 wherein said sensing device comprises an electric sensor arranged over said support surface, said electric sensor being operative to bring about steering action of said edge steering mechanism when said longitudinal edge covers and uncovers said fixed reference.

26. The system of claim 24 wherein said steering mechanism includes at least a pair of spaced driven rolls, a first of said driven rolls having its plane of rotation at an obtuse angle relative the axis of longitudinal movement of said fabric blank, a second of said driven rolls having its plane of rotation at an acute angle relative to said axis of movement and means cooperating with said driven rolls to selectively bring only one of them at any one time into driving contact with said fabric blank during its uninterrupted movement over said support surface.

27. The system of claim 26 wherein said means cooperating to bring said driven rolls into contact with said fabric blank comprise a reciprocally mounted press roll mounted above each of said driven rolls and reciprocal pistons operative to move said press rolls selectively into contact with said driven rolls so that a respective pair of said driven and press rolls are always in steering contact with said fabric blank during its movement over said support surface.

28. The system of claim 26 wherein said means cooperating comprise a pair of mounting pistons reciprocally mounting a press roll above each said driven roll, a sensing device sensing the position of a said longitudinal edge of said moving fabric blank, said sensing device being operative to actuate one of said mounting pistons to bring one of said press rolls into position to engage said fabric blank between said press roll and said driven roll in dependence on the position of said longitudinal edge, such engagement acting to steer said longitudinal edge.

29. The system of claim 28 wherein the plane of rotation of the associated said press rolls and said driven rolls is the same.

30. The system of claim 24 wherein upon entry of a leading end of a successive fabric blank into said aligning section, said sensing device causes moves said idler roll to move into said second position in which said press belt is elevated above said fabric blank.

31. A fabric conveying and edge tucking system comprising:

a table having a support surface over which a fabric blank is conveyed;

conveying belts arranged across and adapted to convey said fabric blank over said table;

said support surface having a recessed longitudinal edge over which an edge of said fabric blank drapes during its conveyance over said table;

edge tucking apparatus arranged adjacent said recessed edge and adapted to engage and tuck said draped edge beneath the support surface of said table;

said edge tucking apparatus comprising a tucking finger which engages and tucks said draped edge and a diagonal belt arranged to extend diagonally of said longitudinal edge, drive means rotating said diagonal belt tangentially of, but substantially in the direction of movement of said fabric blank; whereby, said diagonal belt engages with and further draws and smooths said tucked edge during movement of said fabric blank over said support surface.

32. The fabric edge and conveying system according to claim 31 wherein lower press belts are arranged adjacent said diagonal belt in position to receive, retain, and convey said tucked edge during its further movement over said support surface.

33. The fabric and edge conveying system according to claim 32 wherein entrance ends of said lower press belts are positioned to be adjacent to and staggered along a diagonal direction in which said diagonal belt is driven; whereby, said tucked edge is sequentially picked up by said entrance ends of said lower press belts during movement of said fabric blank over said support surface.

34. The fabric conveying and edge tucking system according to claim 32 wherein there are at least four of said lower press belts, means driving certain of said lower press belts in unison with said conveying belts, said means driving other of said lower press belts slightly faster than said conveying belts.

35. The fabric conveying and edge tucking system of claim 34 wherein said other of said lower press belts comprise intermediate lower press belts.

36. A fabric conveying and edge tucking system comprising: a table having a support surface over which a fabric blank is conveyed; conveying belts extending across said fabric blank for conveying said fabric blank over said table; said support surface having a recessed longitudinal edge over which an edge of said fabric blank drapes during its conveyance over said table; edge tucking apparatus located adjacent said recessed edge for engaging and tucking said draped edge beneath the support surface of said table; said edge tucking apparatus comprising a diagonal belt extending diagonally of said longitudinal edge, drive means rotating said diagonal belt tangentially of, but somewhat offset from the direction of movement of said fabric blank; whereby, said diagonal belt engages, draws, smooths and tucks said edge during movement of said fabric blank over said support surface.

* * * * *